US010711381B2

(12) United States Patent
Li et al.

(10) Patent No.: US 10,711,381 B2
(45) Date of Patent: Jul. 14, 2020

(54) WASHING MACHINE AND CONTROLLING METHOD THEREFOR

(71) Applicant: Qingdao Haier Drum Washing Machine Co., Ltd., Shandong (CN)

(72) Inventors: Wenwei Li, Shandong (CN); Jinkai Wang, Shandong (CN); Jun Wu, Shandong (CN); Rongshuai Cai, Shandong (CN)

(73) Assignee: QINGDAO HAIER DRUM WASHING MACHINE CO., LTD. (CN)

( * ) Notice: Subject to any disclaimer, the term of this patent is extended or adjusted under 35 U.S.C. 154(b) by 319 days.

(21) Appl. No.: 15/556,779

(22) PCT Filed: Oct. 16, 2015

(86) PCT No.: PCT/CN2015/092065
§ 371 (c)(1),
(2) Date: Sep. 8, 2017

(87) PCT Pub. No.: WO2016/141714
PCT Pub. Date: Sep. 15, 2016

(65) Prior Publication Data

US 2018/0057987 A1 Mar. 1, 2018

(30) Foreign Application Priority Data

Mar. 11, 2015 (CN) ..... 2015 1 0106251

(51) Int. Cl.
*D06F 31/00* (2006.01)
*D06F 33/02* (2006.01)
(Continued)

(52) U.S. Cl.
CPC ..... *D06F 31/00* (2013.01); *D06F 33/00* (2013.01); *D06F 34/28* (2020.02); *D06F 2216/00* (2013.01)

(58) Field of Classification Search
CPC ..... D06F 31/00; D06F 33/02; D06F 39/005; D06F 2216/00
(Continued)

(56) References Cited

U.S. PATENT DOCUMENTS

2003/0025733 A1 2/2003 Broker et al.
2010/0269266 A1 10/2010 Lee et al.
2011/0241508 A1 10/2011 Heo

FOREIGN PATENT DOCUMENTS

CN 1648320 A 8/2005
CN 101113557 A 1/2008
(Continued)

OTHER PUBLICATIONS

Extended European Search Report from related European Application No. 15884392.0, dated Oct. 10, 2018.

*Primary Examiner* — Levon J Shahinian
(74) *Attorney, Agent, or Firm* — Burns & Levinson, LLP; Joseph M. Maraia

(57) ABSTRACT

The present disclosure discloses a washing machine and a controlling method therefor. The washing machine includes: a touch display screen, at least two mutually independent washing units, and a control module connected with the touch display screen and the at least two washing units, wherein the at least two washing units include a first washing unit and a second washing unit; and the touch display screen is split into screens to simultaneously display a control menu of the first washing unit and a control menu of the second washing unit. A switching icon is further provided on the touch display screen and is configured to switch interfaces of the two washing units. The touch
(Continued)

display screen is configured to adjust and split screen under a control of the control module to simultaneously display operating states of the corresponding washing units.

20 Claims, 5 Drawing Sheets

(51) Int. Cl.
*D06F 39/00* (2020.01)
*D06F 33/00* (2020.01)
*D06F 34/28* (2020.01)

(58) Field of Classification Search
USPC ..... 68/27
See application file for complete search history.

(56) References Cited

FOREIGN PATENT DOCUMENTS

| | | | |
|---|---|---|---|
| CN | 101876133 | A | 11/2010 |
| CN | 102926168 | A | 2/2013 |
| CN | 103225191 | A | 7/2013 |
| DE | 102008006111 | A1 | 7/2009 |
| JP | H0751180 | B2 | 6/1995 |
| KR | 20100118227 | A | 11/2010 |
| KR | 20110111164 | A | 10/2011 |
| KR | 20120080084 | A | 7/2012 |
| WO | 2008148400 | A1 | 12/2008 |
| WO | 2014128817 | A1 | 8/2014 |

WASHING MACHINE AND CONTROLLING METHOD THEREFOR

CROSS REFERENCE TO RELATED APPLICATIONS

This application is the U.S. national phase entry under 35 U.S.C. § 371 of International Application No. PCT/CN2015/092065, filed Oct. 16, 2015, entitled WASHING MACHINE AND CONTROLLING METHOD THEREFOR, which claims priority to Chinese Patent Application No. 201510106251.2, filed Mar. 11, 2015, the contents of which are incorporated herein by reference in their entirety for all purposes.

TECHNICAL FIELD

The present disclosure relates to a washing apparatus, and particularly relates to a washing machine and a controlling method therefor.

BACKGROUND

In a modern life, a washing machine has become a good helper of human life. With development of the washing machine, a double-drum washing machine is gradually presented in human life. The double-drum washing machine has two mutually independent washing drums, and a user can select any one of the two washing drums to clean clothes or select the two washing drums to clean the clothes simultaneously. Therefore, the clothes can be cleaned according to classification by material categories of the clothes, or categories of adult and baby clothes. Thus, the washing machine is deeply favored by the public.

However, two display panels are mostly adopted by an existing double-drum washing machine to control the two washing drums respectively. Therefore, the production cost is relatively high. In addition, one display panel is adopted by some existing double-drum washing machines, and control interfaces of the washing drums are switched by a physical key and other mechanical modes to respectively control the two washing drums. Therefore, an operation process is complicated, and an appearance is not beautiful, causing inconvenience for the user to view an operating state of the washing drums and set working parameters.

SUMMARY

The present disclosure provides a washing machine and a controlling method therefor, to achieve that a touch display screen of the washing machine is split into screens to control at least two washing units.

In a first aspect, the washing machine provided by the present disclosure includes: a touch display screen, at least two mutually independent washing units, and a control module connected with the touch display screen and the at least two washing units, wherein the at least two washing units include a first washing unit and a second washing unit; and the touch display screen is configured to split screen to simultaneously display a control menu of the first washing unit and a control menu of the second washing unit. A switching icon is further provided on the touch display screen and is configured to switch interfaces of the two washing units. The touch display screen is further configured to split screen under a control of the control module to simultaneously display operating states of corresponding washing units.

Further, the touch display screen displays an initial interface. The initial interface includes two washing unit icons. The two washing unit icons are located in the two control menus respectively, and include: a first icon identifying the first washing unit and a second icon identifying the second washing unit.

The touch display screen enters a configuration interface of the first washing unit after receiving a touch control signal indicating that the first icon is selected; or, the touch display screen enters a configuration interface of the second washing unit after receiving a touch control signal indicating that the second icon is selected.

Further, a plurality of clothes material icons are further displayed in the control menu of each washing unit, and the plurality of clothes material icons at least include: a cotton & linen icon, a silk icon, a jean icon, a down feather icon, a chemical fiber icon, and a wool icon.

The touch display screen directly enters a configuration interface of a corresponding washing unit after receiving a touch control signal indicating that one clothes material icon on the initial interface is selected.

Further, the touch display screen displays a configuration interface of any one of washing units, and the configuration interface displays a state interface of the washing unit and further displays a configuration menu interface including a switching icon and a plurality of function icons.

The touch display screen switches a configuration interface of the current washing unit to a configuration interface of another washing unit after receiving a touch control signal indicating that the switching icon is selected.

The configuration menu interface of the touch display screen further displays a working parameter list corresponding to a function icon, and configures working parameters of the current washing unit after the touch display screen receives a touch control signal indicating that the function icon is selected.

Further, the plurality of function icons of the configuration interface at least include: a washing time icon, a rinsing times icon, a clothes washing temperature icon and a clothes washing rotation speed icon.

Further, the configuration menu interface of the configuration interface further includes: an appointment setting icon, a stain icon and a water level setting icon.

Further, the touch display screen displays an operation interface, and the operation interface is split into screens to simultaneously display an operating state of the first washing unit and an operating state of the second washing unit.

Further, the touch display screen displays the operation interface in real time when the at least one washing unit is in operation.

Further, return icons are further displayed on the configuration interface and the operation interface of the touch display screen respectively.

The touch display screen returns to a previous-level interface of the current interface after receiving a touch control signal indicating that the return icon is selected.

In a second aspect, in a controlling method of a washing machine provided by the present disclosure, the washing machine includes: a touch display screen, at least two mutually independent washing units, and a control module connected with the touch display screen and the at least two washing units. The method includes:

receiving, by the touch display screen, a touch control signal for any one of washing units; and independently controlling, by the control module, a corresponding washing unit according to the touch control signal; and further controlling, by the control module, the touch display screen to split screen to simultaneously display operating states of the corresponding washing unit according to the operating states of the corresponding washing unit.

Further, the touch display screen includes an initial interface, a configuration interface and an operation interface.

The initial interface at least includes two washing unit icons and a plurality of clothes material icons; and the configuration interface includes a switching icon and a plurality of function icons.

Further, the touch display screen directly enters the configuration interface of the washing unit corresponding to an icon after receiving a touch control signal indicating that the icon on the initial interface is selected.

Further, the touch display screen switches the configuration interface of the current washing unit to a configuration interface of another washing unit after receiving a touch control signal indicating that a switching icon on the configuration interface is selected.

The touch display screen also displays a working parameter menu corresponding to a function icon and configures the working parameters of the current washing unit after receiving a touch control signal indicating that the function icon on the configuration interface is selected.

Further, the control module independently controls the corresponding washing unit according to the touch control signal of the touch display screen to operate according to a configuration parameter when the touch display screen is switched to an operation interface from a configuration interface; and the control module controls the touch display screen to split screen to simultaneously display the operating states of the corresponding washing unit in real time according to the operating states of the corresponding washing unit.

Further, the control unit controls the touch screen to display the operation interface in real time when the at least one washing unit is in operation.

Further, return icons are further displayed on the configuration interface and the operation interface of the touch display screen respectively; and the touch display screen returns to a previous-level interface of the current interface after receiving a touch control signal indicating that the return icon is selected.

In the washing machine and the controlling method therefor provided by the present disclosure, the washing machine includes a touch display screen, a control module and at least two mutually independent washing units. Interfaces of the at least two washing units are displayed simultaneously by splitting one touch display screen; and a switching icon is further provided on the touch display screen, and can be configured to rapidly switch an interface of the current washing unit to an interface of another washing unit. The touch display screen is further split under a control of the control module to display operating states of the corresponding washing units simultaneously, so that an operation process of a user for the at least one washing unit is convenient during use, and the cost of the washing machine is reduced in a production process.

BRIEF DESCRIPTION OF DRAWINGS

To illustrate technical solutions in embodiments of the present disclosure more clearly, drawings to be used in the description of embodiments will be simply introduced below. Apparently, drawings described below are some embodiments of the prevent disclosure. Those ordinary skilled in the art can also obtain other drawings according to these drawings without contributing creative labor.

FIG. 3(*b*) is a schematic diagram illustrating another configuration interface of a touch display screen of a washing machine provided by embodiments of the present disclosure;

FIG. 3(*c*) is a schematic diagram illustrating another configuration interface of a touch display screen of a washing machine provided by embodiments of the present disclosure;

FIG. 3(*d*) is a schematic diagram illustrating another configuration interface of a touch display screen of a washing machine provided by embodiments of the present disclosure;

FIG. 4(*b*) is a schematic diagram illustrating another operation interface of a touch display screen of a washing machine provided by embodiments of the present disclosure;

FIG. 4(*c*) is a schematic diagram illustrating another operation interface of a touch display screen of a washing machine provided by embodiments of the present disclosure.

DETAILED DESCRIPTION

To make purposes, technical solutions and advantages of the present disclosure clearer, the technical solutions of the present disclosure will be described clearly and completely below through embodiments by referring to drawings in embodiments of the present disclosure. Apparently, embodiments described are part of embodiments of the present disclosure, rather than all embodiments. Based on embodiments in the present disclosure, all other embodiments obtained by those ordinary skilled in the art without contributing creative labor belong to the protection scope of the present disclosure.

Figure 1:
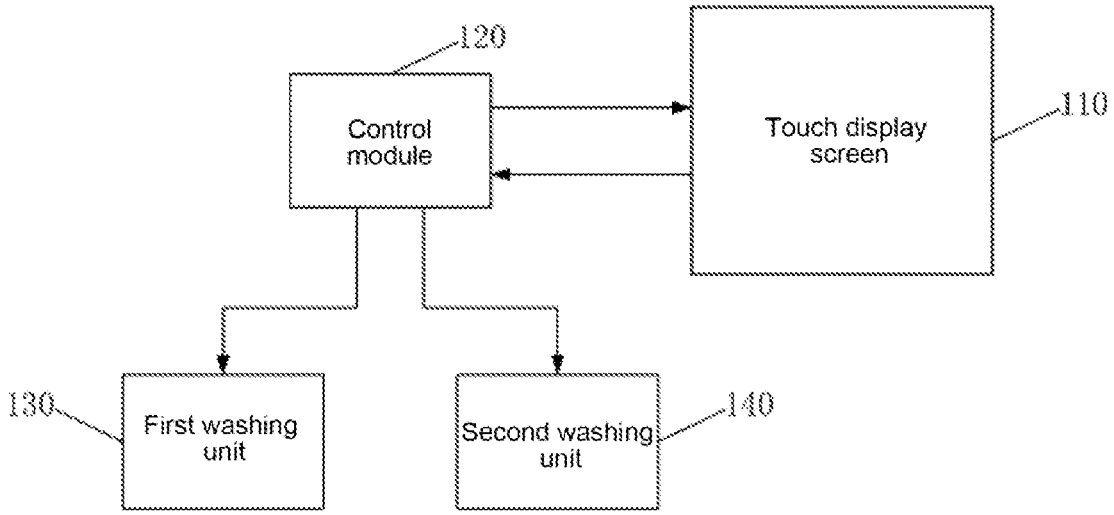
FIG. 1 is a schematic diagram illustrating a washing machine provided by an embodiment of the present disclosure.

FIG. 1 is a schematic diagram illustrating a washing machine provided by one embodiment of the present disclosure. As shown in FIG. 1, the washing machine includes: a touch display screen 110, at least two mutually independent washing units, and a control module 120 connected with the touch display screen 110 and the at least two washing units, wherein the at least two washing units are described by taking two washing units as an example, and include a first washing unit 130 and a second washing unit 140.

Herein, a touch display screen 110 of the present disclosure can be split into screens to simultaneously display a control menu of the first washing unit 130 and a control menu of the second washing unit 140. Therefore, a user can carry out a touch control on a control menu on any one split screen of the touch display screen 110, to control the washing unit corresponding to the split screen and set a working parameter of the corresponding washing unit.

By taking the first washing unit 130 as an example, when the user carries out the touch control on the control menu on the split screen corresponding to the first washing unit 130, the touch display screen 110 receives a touch control signal corresponding to the first washing unit 130, the control module 120 independently controls the first washing unit 130 according to the touch control signal received by the touch display screen 110, and the first washing unit 130 is operated under a control of the control module 120. The control module 120 further monitors an operating state of the first washing unit 130 in real time, and controls a corresponding split screen of the first washing unit 130 to display the operating state of the first washing unit 130 according to the operating state. When a current user does not carry out a touch control operation on the split screen of the second washing unit 140, the second washing unit 140 keeps an original state, and the control module 120 controls a split screen corresponding to the second washing unit 140 in real time to display an operating state of the second washing unit 140 according to a state of the second washing unit 140. In view of this, the split screen corresponding to the second washing unit 140 and the split screen corresponding to the first washing unit 130 can be mutually independent, and the touch display screen 110 is configured to adjust and split screen under the control of the control module 120 to simultaneously display operating states of corresponding washing units.

In addition, a switching icon is further provided on the touch display screen 110 to switch interfaces of two washing units. The touch display screen 110 is usually divided into at least two split screens by using the switching icon provided on the touch display screen 110, wherein one split screen therein is a secondary split screen, and another split screen is a main split screen. An interface size of the secondary split screen on the touch display screen 110 can be less than that of the main split screen, so as to highlight contents on the main split screen, and to facilitate the user to view. By taking the first washing unit 130 corresponding to the current main split screen as an example, a switching icon is displayed on the secondary split screen, and a state interface of the first washing unit 130 is displayed on the main split screen. When the user selects the switching icon, the touch display screen 110 receives a touch control signal, an interface corresponding to the main split screen of the touch display screen 110 is switched, and the switching icon is still displayed on the secondary split screen. Therefore, a working interface of the second washing unit 140 is displayed on the main split screen. Thus, an interface of the current washing unit can be rapidly switched to an interface of another washing unit according to the switching icon.

It is known that the touch display screen 110 is configured to receive a touch control signal for any one of washing units, and the control module 120 is connected with the touch display screen 110 and the two washing units, so that the control module 120 independently controls corresponding washing units according to the touch control signal received by the touch display screen 110, and the corresponding washing units are operated under the control of the control module 120. With operation of any one of washing units, the control module 120 further controls the touch display screen 110 to split screen to simultaneously display an operating state of the washing unit according to the operating state of the washing unit.

To describe the washing machine provided by embodiments of the present disclosure in more detail, the operating state of the washing machine is described herein with a sequence process of operation of the washing machine.

Figure 2:
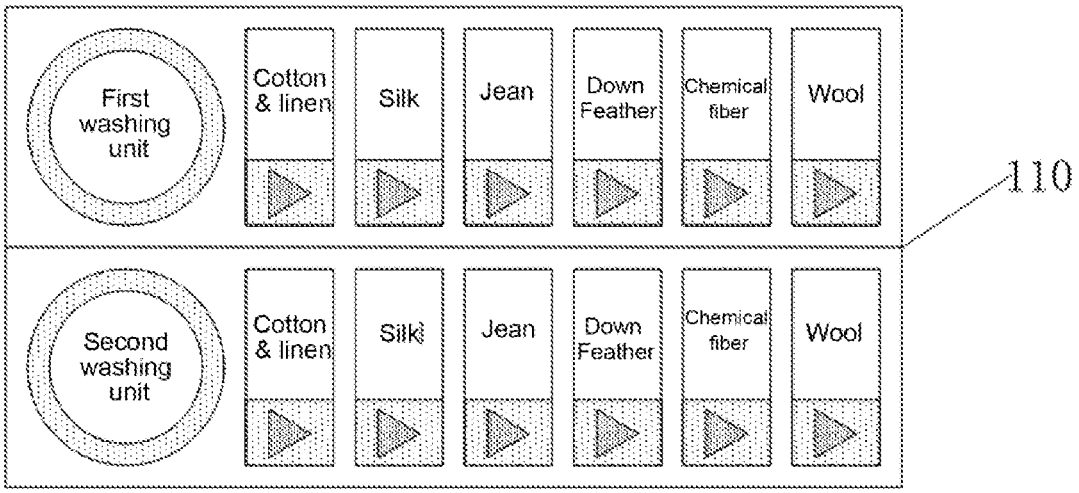
FIG. 2 is a schematic diagram illustrating an initial interface of a touch display screen of a washing machine provided by embodiments of the present disclosure.
Figure 3A:
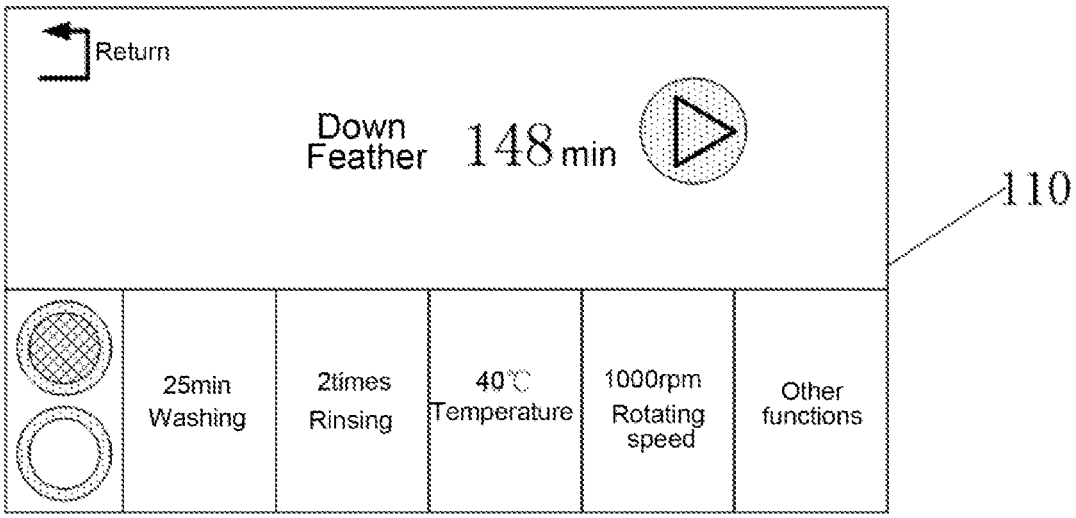
FIG. 3(*a*) is a schematic diagram illustrating a configuration interface of a touch display screen of a washing machine provided by embodiments of the present disclosure.
Figure 3B:
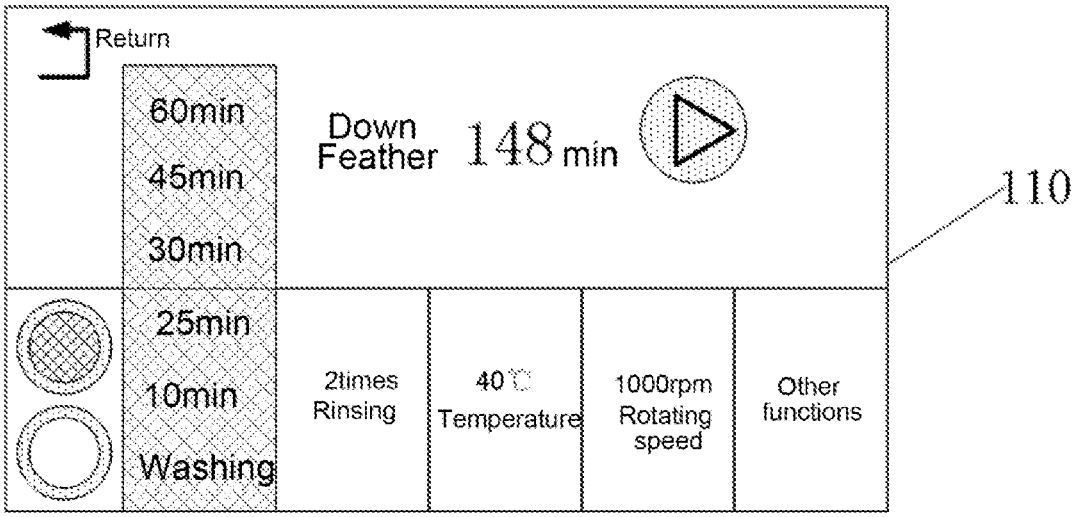
Figure 3C:
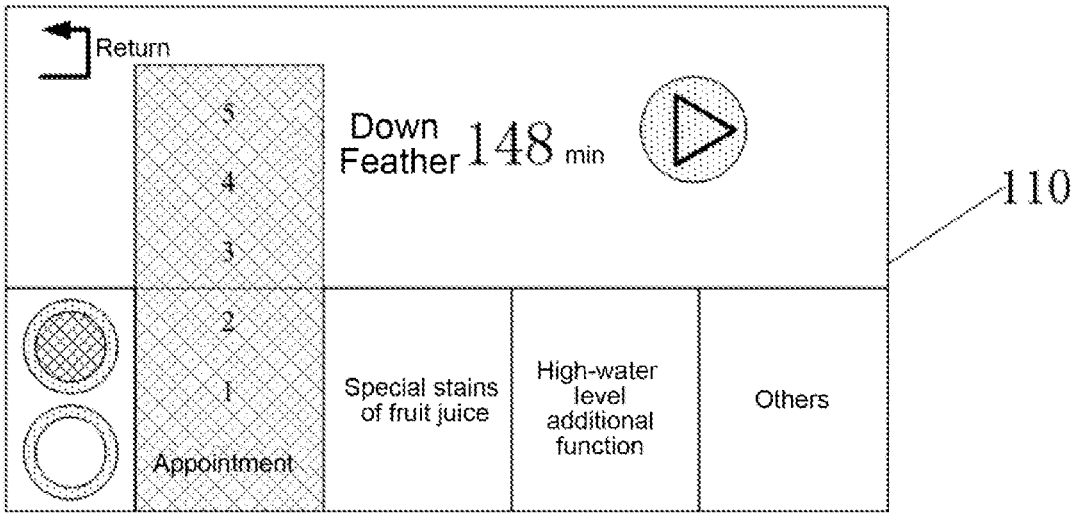
Figure 3D:
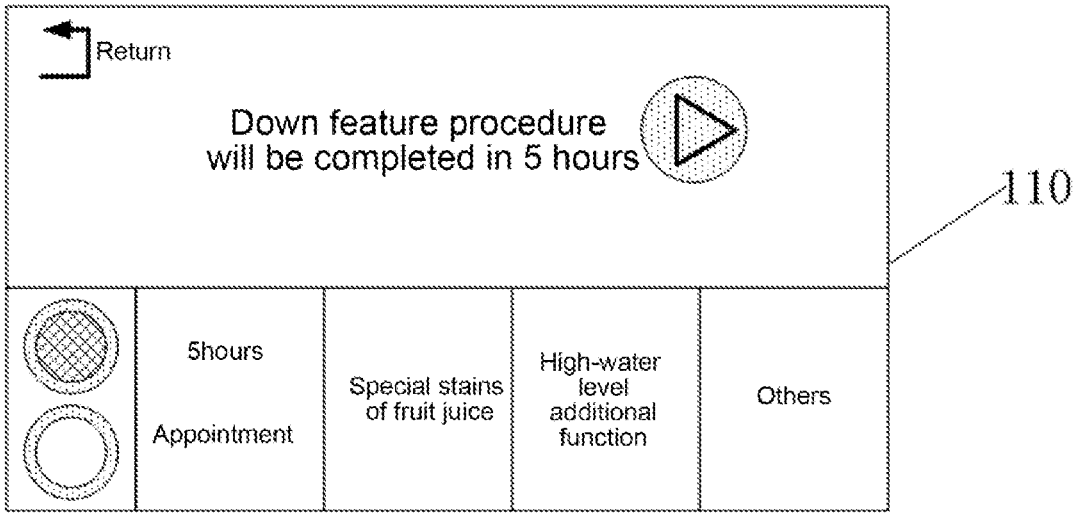

FIG. 2 is a schematic diagram illustrating an initial interface of a touch display screen of a washing machine provided by embodiments of the present disclosure. To reduce an occupied area, a double-drum washing machine can be configured that the two washing units are arranged up and down. Therefore, in FIG. 2, a split screen interface of the first washing unit 130 is displayed on an upper split screen, a control menu of the first washing unit 130 is displayed in the split screen interface; and, a split screen interface of the second washing unit 140 is displayed on a lower split screen, and a control menu of the second washing unit 140 is displayed in the split screen interface. For the touch display screen 110, in all other interfaces of touch display screen 110 except for a configuration interface, the upper split screen is generally used for the split screen interface of the first washing unit 130, and the lower split screen is generally used for the split screen interface of the second washing unit 140, which is taken as a standard hereinafter, so specific instruction and identification will not be given again.

The touch display screen 110 displays an initial interface when the user places clothes in the selected washing unit and controls the washing machine to start. The initial interface is divided into two split screens. Each of the split screens is configured to display a control menu of one washing unit. Specifically, the initial interface includes two washing unit icons. The two washing unit icons are located in two control menus respectively. Therefore, the initial interface is split into screens to simultaneously display the control menus of the two washing units. Herein, the two washing unit icons include a first icon identifying the first washing unit 130 and a second icon identifying the second washing unit 140. Currently, the two split screens have similar structures. Therefore, division proportions of the two split screens of the initial interface on the touch display screen 110 are the same, and the user can enter configuration interfaces of the corresponding washing units by selecting corresponding icons. Optionally, the touch display screen 110 enters the configuration interface of the first washing unit 130 after receiving a touch control signal indicating that the first icon is selected; or, the touch display screen 110 enters the configuration interface of the second washing unit 140 after receiving a touch control signal indicating that the second icon is selected.

In addition, since materials of clothes are diversified and washing conditions of the clothes with different materials are also different, a plurality of clothes material icons are also simultaneously displayed in the control menu of each washing unit on the initial interface, and the plurality of clothes material icons at least include: a cotton & linen icon, a silk icon, a jean icon, a down feather icon, a chemical fiber icon, and a wool icon. Herein, the control menu of any one of washing units includes the plurality of clothes material icons. By taking the first washing unit 130 as an example, the user places jeanswear in the first washing unit 130 and then can directly select the jean icon in the control menu of the split screen corresponding to the first washing unit 130 according to the material of the clothes to be washed. The touch display screen 110 enters the configuration interface of the first washing unit 130 when receiving a touch control signal indicating that the jean icon in the split screen corresponding to the first washing unit 130 is selected. A process that the user selects an icon in the split screen corresponding to the second washing unit 140 is similar to that of the first washing unit 130, and is not repeated herein. Therefore, optionally, the touch display screen 110 directly enters the configuration interfaces of the corresponding washing units when receiving a touch control signal indicating that one clothes material icon on the initial interface is selected.

FIG. 3(*a*) is a schematic diagram illustrating one configuration interface of a touch display screen of a washing machine provided by embodiments of the present disclosure. The user selects an icon of one washing unit or selects one clothes material icon on the initial interface, so that the touch display screen 110 will directly switch the display content and display the configuration interface of the selected washing unit after receiving a touch control signal indicating that an icon on the initial interface is selected.

By taking the first washing unit 130 as an example, when the user selects the first icon on the initial interface, the touch display screen 110 receives a touch control signal, and directly enters the configuration interface of the first washing unit 130. Herein, a default working parameter is preset in the configuration interface, and the working parameter is not a working parameter of a certain clothes material, but a default working parameter of general clothes washing preset by the washing machine. The user can modify the working parameter, or directly set the first washing unit 130 for washing according to the default working parameter. Or, as shown in FIG. 3(*a*), the user selects another clothes material icon on the split screen corresponding to the first washing unit 130 on the initial interface. By taking the down feather icon as an example, when the user selects the down feather icon, the touch display screen 110 receives a touch control signal, and directly enters a configuration interface of down clothes of the first washing unit 130. Therefore, the touch display screen 110 displays the configuration interface of the first washing unit 130. A default working parameter of down clothes washing is preset on the configuration interface, and the working parameter is a relatively reasonable washing working parameter set by the washing machine according to a material of the down feather. The user can modify the working parameter, and also can directly set the first washing unit 130 for washing according to the default working parameter.

Specifically, when a configuration interface of any one of washing units is displayed on the current configuration interface, not only a state interface of the washing unit is displayed, but also a configuration menu interface including the switching icon and the plurality of function icons is displayed, wherein the switching icon and the plurality of function icons are located in the same split screen, and a state interface of the washing unit selected currently is displayed on another split screen. Thus, the user can configure the working parameter of the washing unit clearly and rapidly through the configuration interface. Herein, a state interface on the configuration interface is the main split screen, and the configuration menu interface is the secondary split screen. An interface size of the secondary split screen is less than that of the main split screen, so as to facilitate the user to view the state of the current washing unit.

For the switching icon on the configuration interface, switch identification is usually carried out with two similar circles, wherein a solid circle can represent the current washing unit, and a hollow circle can represent another washing unit. The configuration interface is not changed and is still the configuration interface of the current washing unit when the user selects the solid circle. When the user selects the hollow circle, the touch display screen 110 receives a touch control signal, and the current configuration interface is transformed into a configuration interface of another washing unit. Therefore, optionally, the touch display screen 110 switches the configuration interface of the current washing unit into the configuration interface of another washing unit when receiving a touch control signal indicating that the switching icon is selected, which is convenient and efficient.

The configuration interface has a plurality of function icons if the working parameter of the corresponding washing unit is set on the configuration interface. Each of the function icons represents a washing function of the washing unit and includes a working parameter list. The working parameter list has a plurality of parameter options. The user can voluntarily select a washing parameter of the washing unit from the plurality of parameter options. Therefore, optionally, the working parameter list corresponding to the function icon is also displayed on the configuration menu interface of the touch display screen 110 and the working parameter of the current washing unit is configured when the touch display screen 110 receives the touch control signal indicating that the function icon is selected.

It is known that clothes washing should include processes of washing, rinsing and the like. Clothes washing quality is affected by clothes washing temperature and clothes washing rotation speed. Therefore, optionally, the plurality of function icons of the configuration interface at least include: a washing time icon, a rinsing times icon, a clothes washing temperature icon, clothes washing rotation speed icon, and the like. The user can select each washing function for setting, or the user directly washes with the default working parameter without setting the working parameter. As shown in FIG. 3(*a*), the user sets the first washing unit 130 as the down clothes, so that the default working parameters of the washing machine are as follows: washing for 25 min, and rinsing for 2 times, at a temperature of 40° C. and a rotation speed of 1000 rpm. The user can select the corresponding function icon. The touch display screen 110 displays the working parameter list corresponding to the selected function icon after receiving the touch control signal. The user can modify the working parameter according to the parameter options in the working parameter list, so as to make the first washing unit 130 operate with the working parameters set by the user.

FIG. 3(*b*) is a schematic diagram illustrating another configuration interface of a touch display screen of a washing machine provided by embodiments of the present disclosure. The user can select the washing time icon when the user voluntarily sets the working parameters, and a working parameter menu is displayed in the washing time icon and the working parameter menu includes a plurality of washing time options in a unit of minute, such as 10 min, 25 min, 30 min, 45 min and 60 min. The user can set the washing time of the current washing unit according to demands of the user. The user selects the rinsing times icon, and the specific rinsing times option includes 1, 2, 3, 4 and the like. The user voluntarily sets the rinsing times of the current washing unit. The user selects a clothes washing temperature icon. The user voluntarily selects the clothes washing temperature of the current washing unit according to the temperature options in the clothes washing temperature icon. The user selects the clothes washing rotation speed icon, and voluntarily sets the clothes washing rotation speed of the current washing unit according to rotation speed options provided in the clothes washing rotation speed icon. Therefore, the user sets working parameters of the current washing unit by selecting at least one function iron, or the user takes default working parameters as the working parameters of the current washing unit. As shown in FIG. 3(*b*), the user selects the washing time icon to set the washing time.

FIG. 3(*c*) is a schematic diagram illustrating another configuration interface of a touch display screen of a washing machine provided by embodiments of the present disclosure. The configuration menu interface of the configuration interface of the touch display screen 110 further includes other function icons which are multifunction options of the washing machine. If the user has a corresponding need, other function icons can be selected. The touch display screen 110 enters a configuration interface of other functions of the current washing unit and displays a plurality of icons after receiving a touch control signal indicating that other function icons are selected. There is no need to select the other function icons if the user does not need to set other functions of the washing units. Specifically, when the user selects the other function icons, the other function icons at least include: an appointment setting icon, a stain icon and a water level setting icon. The user selects other function icons. The touch display screen 110 enters other function configuration interfaces after receiving a touch control signal indicating that other function icons are selected, and the user sets other washing parameters of the current washing unit. Other function configuration interfaces further include an "others" icon, and relevant setting of the washing machine is entered when the user selects the "others" icon, which is not repeated herein.

If the user does not need to wash the clothes at the present moment, the appointment setting icon can be selected. The touch display screen 110 displays the working parameter list corresponding to the appointment setting icon after receiving a touch control signal indicating that the appointment setting icon is selected, and the user selects parameters from appointment options of the working parameter list for washing appointment, wherein the appointment option in the appointment setting icon is an appointment time option in a unit of hour, and the user sets an appointment time. When the clothes to be washed is stained with oil stain, stain or fruit juice and other special stains difficult to clean, the user can select the stain icon for stain setting, and after the touch display screen 110 receives a touch control signal indicating that the stain icon is selected, a cleaning process for the stain will be strengthened when the control module 120 controls the washing unit to wash. A washing water level can be set to be high or low by selecting the water level setting icon when the user has a requirement for the water level of the washing clothes.

FIG. 3(*d*) is a schematic diagram illustrating another configuration interface of a touch display screen of a washing machine provided by embodiments of the present disclosure. The user specifically sets the down clothes that the current washing unit prepares to wash, and the set appointment time is 5 hours. Then, the washing machine starts appointment timing when the user selects a start key, and after 5 hours the washing machine washes the clothes in the current washing unit according to the working parameters set by the user. In addition, one split screen displays that a state of the current washing unit is a working state that a down feather procedure will be completed in 5 hours, and another split screen displays an interface including the switching icon, a plurality of function icons and the like.

Thus, the user completes the setting of the working parameters of the current washing unit according to various functions of the configuration interface. The user can select the switching icon at any time to directly switch the configuration interface of the washing unit and configures the working parameters of another washing unit in a process that the user configures the working parameters of the current washing unit.

Figure 4A:
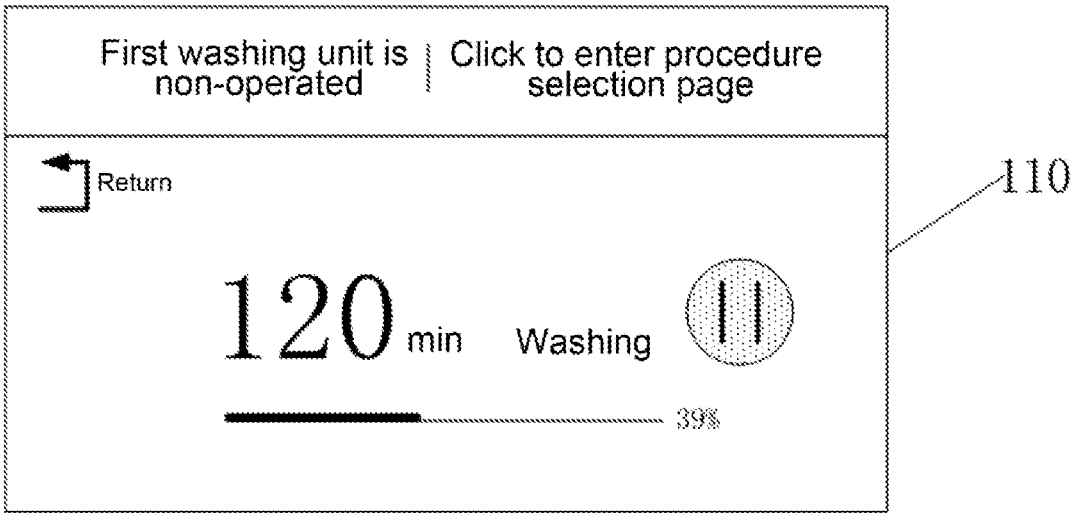
FIG. 4(*a*) is a schematic diagram illustrating an operation interface of a touch display screen of a washing machine provided by embodiments of the present disclosure.
Figure 4B:
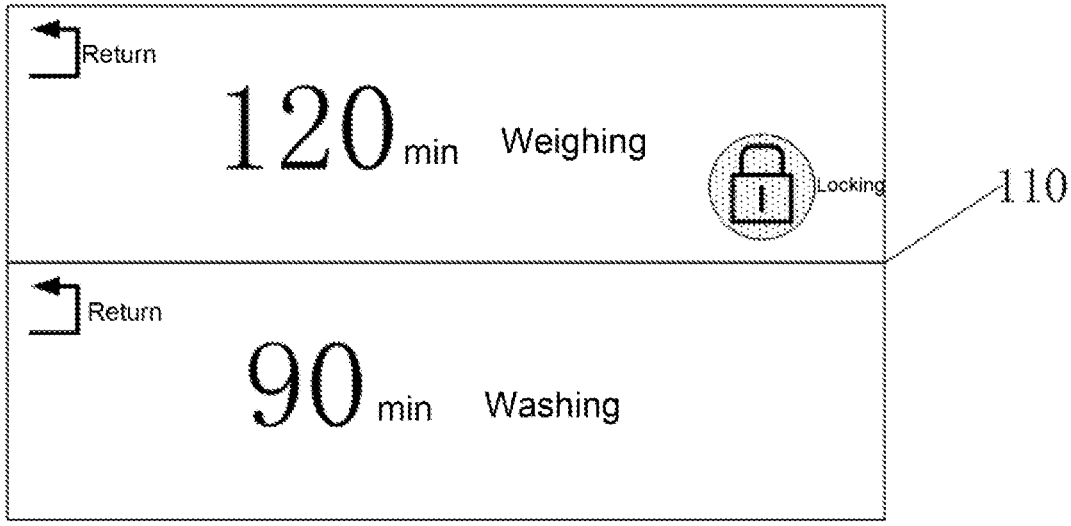
Figure 4C:
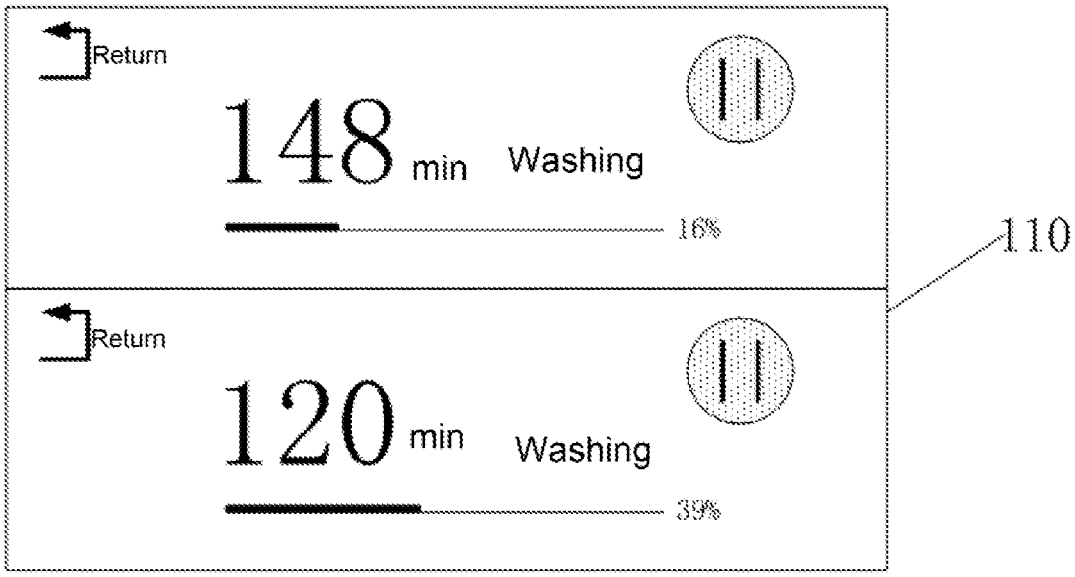

FIG. 4(*a*) is a schematic diagram illustrating one operation interface of a touch display screen of a washing machine provided by embodiments of the present disclosure. A start key of the configuration interface is clicked after the configuration of the configuration interface is completed. It is known that control module 120 is connected with the touch display screen 110, so that the touch display screen 110 receives the setting of a user on the configuration interface and a touch control signal for starting washing operation and the like, and the control module 120 controls the corresponding washing units according to the touch control signal to wash according to the working parameters configured by the user. Thus, the touch display screen 110 is transformed to an operation interface. The touch display screen 110 is split into screens to simultaneously display the operating states of the washing units. As shown in the Figure, the touch display screen 110 displays the operation interface, and the operation interface is split into screens to simultaneously display the operating state of the first washing unit 130 and the operating state of the second washing unit 140.

By taking the second washing unit 140 shown in FIG. 4(*a*) as an example, it can be known that the first washing unit 130 is not operated when the second washing unit 140 is in a washing process. Therefore, the operation interface takes the second washing unit 140 during washing as the main split screen, and the split screen interface has a relatively big proportion; and the operation interface takes the first washing unit 130 which is not operated as the secondary split screen, and the split screen interface has a relatively small proportion, and is located at one side of the touch display screen 110.

For the second washing unit 140 in operation, the operating state (such as, washing time: 120 min, washing progress: 39%, and the washing state: undergoing washing) of the second washing unit 140 is displayed on the split screen interface of the second washing unit 140 if the second washing unit 140 is undergoing washing. The operating state of the second washing unit 140 displayed on the split screen interface of the second washing unit 140 is that the procedure will be completed in x hours, and an appointment progress, and the like if the second washing unit 140 is undergoing appointment. When the second washing unit 140 is undergoing washing or appointment, the user can select to pause the operating state of the second washing unit 140 through the split screen interface of the second washing unit 140; and the control module 120 controls the second washing unit 140 to pause operation according to a touch control signal after the touch display screen 110 receives the touch control signal indicating that a pause icon is selected; or, when the second washing unit 140 is undergoing washing pause or appointment pause, the control module 120 controls the second washing unit 140 to start operation according to a touch control signal after the touch display screen 110 receives the touch control signal indicating that a start icon is selected.

For the first washing unit 130 which is not operated, "the first washing unit 130 is not operated | Click to enter a procedure selection page" is displayed on the split screen interface of the first washing unit 130. If the user needs to start the first washing unit 130, the user can select the split screen interface of the first washing unit 130 on the operation interface, and click the split screen interface; and the touch display screen 110 enters the procedure selection page of the first washing unit 130 after receiving a touch control signal indicating that the split screen interface of the first washing unit 130 is selected, thereby realizing the configuration or operation for the first washing unit 130.

FIG. 4(*b*) is a schematic diagram illustrating another operation interface of a touch display screen of a washing machine provided by embodiments of the present disclosure. By taking a state that the second washing unit 140 is operated and the first washing unit 130 is not operated as an example, if the user selects the split screen interface of the first washing unit 130 and places the clothes in the first washing unit 130, the split screen interfaces of the touch display screen 110 have the same proportion, the split screen interface of the first washing unit 130 has the same size as that of the second washing unit 140, two split screens on the touch display screen 110 are transformed into a state of 1:1, the control module 120 controls the split screen of the first washing unit 130 on the touch display screen 110 to display the state of the first washing unit 130 according to the operating state of the first washing unit 130, and the split screen interface corresponding to the current first washing unit 130 displays a state of weighing the clothes in the first washing unit 130. After weighing is completed, the user selects a locking key and unlocks by long pressing for 3 seconds. The touch display screen 110 receives the touch control signal for an unlocking icon, so the touch display screen 110 is unlocked and returned to the operation interface. The user can select to configure the working parameters of the first washing unit 130.

By taking a state that the second washing unit 140 is operated and the first washing unit 130 is not operated as an example, if the clothes are placed in the first washing unit 130 in advance, the user selects the non-operating split screen of the first washing unit 130 on the touch display screen 110, the split screen interface of the first washing unit 130 on the touch display screen 110 is directly transformed into the configuration interface of the first washing unit 130, and the user configures the working parameters of the first washing unit 130 through the split screen of the first washing unit 130, and starts the first washing unit 130.

FIG. 4(*c*) is a schematic diagram illustrating another operation interface of a touch display screen of a washing machine provided by embodiments of the present disclosure. The user selects to operate the first washing unit 130 and also selects to operate the second washing unit 140, then the proportion of the two split screens on the operation interface of the touch display screen 110 is transformed into a state of 1:1, and the touch display screen 110 is split into screens to independently display the operating states of the two washing units simultaneously. Herein, the user can pause the operating state of the washing unit in operation when the current operating state of the at least one washing unit is in operation, or the user can modify the operating state of the paused washing unit if the current operating state of the at least one washing unit is pause, so as to operate the washing unit. For any one of washing units in operation, the user can also set to reuse the water in the washing unit, and or set to lock the operation of any one of washing units.

As mentioned above, the user carries out the touch control on the touch display screen 110. The touch display screen 110 receives the touch control signal, and the control module 120 independently controls the corresponding washing units according to the touch control signal received by the touch display screen 110, e.g., controls the washing time, the rinsing times, the washing rotation speed and the like of the washing units. When the user starts any one of washing units, the control module 120 controls the corresponding washing units according to the touch control signal to perform washing operation according to the set working parameters. In an operation process of any washing unit, the control module 120 monitors the operating states of the washing units in real time, and controls the touch display screen 110 to split into screens to simultaneously display the operating states of the corresponding washing units according to the operating states of the corresponding washing units. The split screen interface of the touch display screen 110 is also correspondingly changed according to the operating states of different washing units.

As mentioned above, for the operation interface of the touch display screen 110, when the user operates the two washing units, the split screen interfaces of the two washing units on the touch display screen 110 have the same proportion; and when the user operates one washing unit, the split screen of the washing unit in operation is taken as the main split screen, the split screen of the non-operating washing unit is taken as the secondary split screen, and the interface size of the main split screen is greater than that of the secondary split screen.

As mentioned above, for the touch display screen 110, when the user operates the at least one washing unit, the touch display screen 110 displays the operation interface in real time to facilitate the user to use the washing machine safely and conveniently. The user can conveniently view the operating states of the washing units, and can operate the washing machine safely.

As mentioned above, to facilitate the operation, optionally, return icons are respectively displayed on the configuration interface and the operation interface of the touch display screen, namely, a return icon is provided on a split screen configuration interface of the first washing unit 130, a split screen configuration interface of the second washing unit 140, the operation interface of the first washing unit 130 and the operation interface of the second washing unit 140 respectively. The user selects the return icon, and the touch display screen 110 returns to a previous-level interface of the current interface after receiving a touch control signal indicating that the return icon is selected.

A washing machine provided by embodiments of the present disclosure includes a touch display screen 110, a control module 120 and at least two mutually independent washing units. Interfaces of the at least two washing units are simultaneously displayed by splitting one touch display screen 110; and a switching icon is further provided on the touch display screen 110, and the switching icon can be configured to rapidly switch an interface of the current washing unit to an interface of another washing unit. The touch display screen 110 is further split into screens under the control of the control module 120 to simultaneously display operating states of the corresponding washing units, so that an operation process of a user for the at least one washing unit is convenient during use, and the cost of the washing machine is reduced in a production process.

Figure 5:
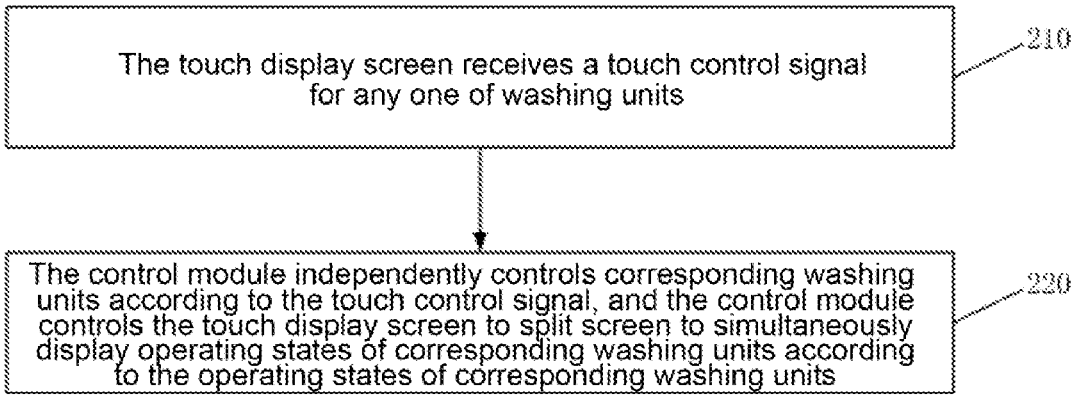
FIG. 5 is a flow chart illustrating a controlling method of a washing machine provided by another embodiment of the present disclosure.

FIG. 5 is a flow chart illustrating a controlling method of a washing machine provided by another embodiment of the present disclosure. The technical solution of the present embodiment is applicable to a situation that the washing machine includes at least two independent washing units and one touch display screen.

In a controlling method of a washing machine provided by the present disclosure, the washing machine includes: a touch display screen, at least two mutually independent washing units, and a control module connected with the touch display screen and the at least two washing units, wherein the method includes the following steps.

In step 210, the touch display screen receives a touch control signal for any one of washing units; and in step 220, the control module independently controls the corresponding washing units according to the touch control signal; and the control module further controls the touch display screen to split screen to simultaneously display operating states of the corresponding washing units according to the operating states of the corresponding washing units.

Further, the touch display screen includes an initial interface, a configuration interface and an operation interface.

The initial interface at least includes two washing unit icons and a plurality of clothes material icons; and the configuration interface includes a switching icon and a plurality of function icons.

Further, the touch display screen directly enters configuration interfaces of the washing unit corresponding to an icon after receiving a touch control signal indicating that the icon on the initial interface is selected.

Further, the touch display screen switches a configuration interface of the current washing unit to a configuration interface of another washing unit after receiving a touch control signal indicating that a switching icon on the configuration interface is selected.

The touch display screen further displays a working parameter list corresponding to a function icon and configures working parameters of the current washing unit after receiving a touch control signal indicating that the function icon on the configuration interface is selected.

Further, the control module independently controls, according to the touch control signal of the touch display screen, the corresponding washing units to operate according to configuration parameters when the touch display screen is switched to an operation interface from a configuration interface; and the control module controls the touch display screen to split screen to simultaneously display operating states of the corresponding washing units in real time according to the operating states of the corresponding washing units.

Further, the control unit controls the touch screen to display the operation interface in real time when the at least one washing unit is in operation.

Further, return icons are also displayed on the configuration interface and the operation interface of the touch display screen respectively; and the touch display screen returns to a previous-level interface of the current interface after receiving a touch control signal indicating that the return icon is selected.

For a controlling method of a washing machine provided by another embodiment of the present disclosure, interfaces of the at least two washing units are simultaneously displayed by splitting one touch display screen; and a switching icon is further provided on the touch display screen, and the switching icon can be configured to switch an interface of the current washing unit to an interface of another washing unit. The touch display screen is further split into screens under the control of the control module to simultaneously display operating states of the corresponding washing units, so that an operation process of a user for the at least one washing unit is convenient during use, and the cost of the washing machine is reduced in a production process.

It should be noted that the above contents are only preferred embodiments of the present disclosure and used technical principles. It can be understood for those skilled in the art that the present disclosure is not limited to specific embodiments described herein. For those skilled in the art, the present disclosure can be subjected to various apparent variations, readjustments and replacements without departing from a protection scope of the present disclosure. Therefore, although the present disclosure is described in detail through above embodiments, the present disclosure is not only limited to above embodiments. The present disclosure can also include more other equivalent embodiments without deviating from conceptions of the present disclosure. A scope of the present disclosure is determined by a scope of attached claims.

What is claimed is:

1. A washing machine, comprising:

a touch display screen, at least two mutually independent washing units comprising a first washing unit and a second washing unit, at least one processor coupled to the touch display screen and to the at least two independent washing units, and a non-transitory computer-readable storage medium storing instructions executable by the at least one processor, wherein the instructions, when executed by the at least one processor, are configured to:

cause the touch display screen to split screen to simultaneously display a control menu of the first washing unit and a control menu of the second washing unit;

further provide a switching icon on the touch display screen which is configured to switch between interfaces of the at least two independent washing units; and further cause the touch display screen to split screen to simultaneously display operating states of the at least two independent washing units.

2. The washing machine according to claim 1, wherein:

the touch display screen is configured to display an initial interface which comprises two washing unit icons located in the control menu of the first washing unit and the control menu of the second washing unit, respectively, the two washing unit icons comprising a first icon identifying the first washing unit and a second icon identifying the second washing unit; and the touch display screen is configured to enter a configuration interface of the first washing unit in response to receiving a touch control signal indicating that the first icon is selected, or, the touch display screen is configured to enter a configuration interface of the second washing unit in response to receiving a touch control signal indicating that the second icon is selected.

3. The washing machine according to claim 2, wherein:

a plurality of clothes material icons are further displayed in the control menu of each of the first washing unit and the second washing unit, and the plurality of clothes material icons at least comprise: a cotton & linen icon, a silk icon, a jean icon, a down feather icon, a chemical fiber icon, and a wool icon; and the touch display screen is configured to directly enter a configuration interface of a corresponding washing unit in response to receiving a touch control signal indicating that one of the clothes material icons on the initial interface is selected.

4. The washing machine according to claim 1, wherein:

the touch display screen is configured to display a configuration interface of any one of washing units, and the configuration interface is configured to display a state interface of the washing unit and further display a configuration menu interface comprising a switching icon and a plurality of function icons, wherein the touch display screen is configured to switch a configuration interface of the current washing unit to a configuration interface of another washing unit in response to receiving a touch control signal indicating that the switching icon is selected; and the configuration menu interface of the touch display screen is configured to further display a working parameter list corresponding to a function icon, and configure working parameters of the current washing unit in response to the touch display screen receiving a touch control signal indicating that the function icon is selected.

5. The washing machine according to claim 4, wherein the plurality of function icons of the configuration interface at least comprise: a washing time icon, a rinsing times icon, a clothes washing temperature icon and a clothes washing rotation speed icon.

6. The washing machine according to claim 5, wherein return icons are further displayed on the configuration interface and the operation interface of the touch display screen respectively; and the touch display screen returns to a previous-level interface of the current interface after receiving a touch control signal indicating that the return icon is selected.

7. The washing machine according to claim 4, wherein the configuration menu interface of the configuration interface further comprises: an appointment setting icon, a stain icon and a water level setting icon.

8. The washing machine according to claim 7, wherein return icons are further displayed on the configuration interface and the operation interface of the touch display screen respectively; and the touch display screen returns to a previous-level interface of the current interface after receiving a touch control signal indicating that the return icon is selected.

9. The washing machine according to claim 4, wherein return icons are further displayed on the configuration interface and the operation interface of the touch display screen respectively; and the touch display screen is configured to return to a previous-level interface of the current interface after receiving a touch control signal indicating that the return icon is selected.

10. The washing machine according to claim 1, wherein the touch display screen is configured to display an operation interface, and the operation interface is configured to be split into screens to simultaneously display an operating state of the first washing unit and an operating state of the second washing unit.

11. The washing machine according to claim 10, wherein the touch display screen is configured to display the operation interface in real time when the at least one washing unit is in operation.

12. A controlling method of a washing machine, the washing machine comprising:

a touch display screen, at least two mutually independent washing units comprising at least a first washing unit and a second washing unit, and a control module connected with the touch display screen and the at least two washing units, wherein the touch display screen is configured to split screen to simultaneously display a control menu of the first washing unit and a control menu of the second washing unit; a switching icon is further provided on the touch display screen and is configured to switch interfaces of the at least two washing units; and the touch display screen is further configured to split screen under a control of the control module to simultaneously display operating states of the corresponding washing units; and wherein the method comprises:

receiving, by the touch display screen, a touch control signal for any one of washing units; and independently controlling, by the control module, a corresponding washing unit according to the touch control signal; and further controlling, by the control module, the touch display screen to split screen to simultaneously display operating states of the corresponding washing unit according to the operating states of the corresponding washing unit.

13. The controlling method according to claim 12, wherein the touch display screen comprises an initial interface, a configuration interface and an operation interface, wherein the initial interface at least comprises two washing unit icons and a plurality of clothes material icons; and the configuration interface comprises a switching icon and a plurality of function icons.

14. The controlling method according to claim 13, wherein the touch display screen directly enters the configuration interface of the washing unit corresponding to an icon after receiving a touch control signal indicating that the icon on the initial interface is selected.

15. The controlling method according to claim 14, wherein return icons are further displayed on the configuration interface and the operation interface of the touch display screen respectively; and the touch display screen returns to the previous-level interface of the current interface after receiving a touch control signal indicating that the return icon is selected.

16. The controlling method according to claim 13, wherein the touch display screen switches a configuration interface of the current washing unit to a configuration interface of another washing unit after receiving a touch control signal indicating that a switching icon on the configuration interface is selected; and the touch display screen further displays a working parameter list corresponding to a function icon, and configures working parameters of the current washing unit after receiving a touch control signal indicating that the function icon on the configuration interface is selected.

17. The controlling method according to claim 16, wherein return icons are further displayed on the configuration interface and the operation interface of the touch display screen respectively; and the touch display screen returns to the previous-level interface of the current interface after receiving a touch control signal indicating that the return icon is selected.

18. The controlling method according to claim 13, wherein the control module independently controls the corresponding washing unit to operate according to a configuration parameter in accordance with the touch control signal of the touch display screen when the touch display screen is switched to an operation interface from a configuration interface; and the control module controls the touch display screen to split screen to simultaneously display the operating states of the corresponding washing unit in real time according to the operating states of the corresponding washing unit.

19. The controlling method according to claim 18, wherein the control unit controls the touch screen to display the operation interface in real time when the at least one washing unit is in operation.

20. The controlling method according to claim 13, wherein return icons are further displayed on the configuration interface and the operation interface of the touch display screen respectively; and the touch display screen returns to the previous-level interface of the current interface after receiving a touch control signal indicating that the return icon is selected.

* * * * *